US010190844B2

(12) United States Patent
Iwasawa

(10) Patent No.: US 10,190,844 B2
(45) Date of Patent: Jan. 29, 2019

(54) SIGHT ADJUSTMENT DEVICE IN SIMULATION GUN

(71) Applicant: TOKYO MARUI CO, LTD., Tokyo (JP)

(72) Inventor: Iwao Iwasawa, Tokyo (JP)

(73) Assignee: TOKYO MARUI CO., LTD., Tokyo (JP)

( * ) Notice: Subject to any disclaimer, the term of this patent is extended or adjusted under 35 U.S.C. 154(b) by 0 days.

(21) Appl. No.: 15/560,554

(22) PCT Filed: Mar. 24, 2015

(86) PCT No.: PCT/JP2015/058936

§ 371 (c)(1),
(2) Date: Sep. 22, 2017

(87) PCT Pub. No.: WO2016/151765

PCT Pub. Date: Sep. 29, 2016

(65) Prior Publication Data

US 2018/0051958 A1 Feb. 22, 2018

(51) Int. Cl.
*F41B 11/70* (2013.01)
*F41B 11/642* (2013.01)
*F41B 11/646* (2013.01)

(52) U.S. Cl.
CPC ..... *F41B 11/70* (2013.01); *F41B 11/642* (2013.01); *F41B 11/646* (2013.01)

(58) Field of Classification Search
CPC ..... F41B 11/70; F41B 11/642; F41B 11/71; F41B 11/72; F41B 11/721; F41B 11/723
USPC ..... 124/71–77, 59
See application file for complete search history.

(56) References Cited

U.S. PATENT DOCUMENTS 5,988,153 A * 11/1999 Yoshimura ..... F41B 11/00 124/81
7,762,248 B1 * 7/2010 Squire ..... F41B 11/00 124/80
9,103,624 B1 * 8/2015 Kung ..... F41B 11/62
9,541,346 B1 * 1/2017 Huang ..... F41B 11/89
(Continued)

FOREIGN PATENT DOCUMENTS

JP 06-003091 1/1994
JP 10220994 A * 8/1998
(Continued)

OTHER PUBLICATIONS

International Search Report dated Jun. 16, 2015.

*Primary Examiner* — John Cooper
(74) *Attorney, Agent, or Firm* — Jacobson Holman, PLLC.

(57) ABSTRACT

A sight adjustment device, which adjusts a course of a bullet to be shot when shooting the bullet loaded in a cartridge portion of each of barrels, in a simulation gun having a plurality of the barrels includes a plurality of pressurization members that add pressure to the bullet loaded in each cartridge portion such that rotation is applied to each bullet; link members that are provided on a side of a gun main body such that one end portion is disposed on a side of the pressurization members and the other end portion is disposed on a side of operation units, and transmit operations of the operation units to the pressurization members; and the operation units that are provided on the side of the gun main body in order to adjust a backspin amount.

5 Claims, 17 Drawing Sheets

(56) References Cited

U.S. PATENT DOCUMENTS

| | | | | |
|---|---|---|---|---|
| 9,823,040 | B1 * | 11/2017 | Hu | F41B 11/70 |
| 2005/0178877 | A1 * | 8/2005 | Marsac | F41A 21/02 244/3.21 |
| 2007/0017498 | A1 * | 1/2007 | Finstad | F41A 21/32 124/84 |
| 2007/0125351 | A1 * | 6/2007 | Campo | F41A 21/32 124/56 |
| 2010/0043766 | A1 * | 2/2010 | Iwasawa | F41A 17/34 124/40 |
| 2012/0272941 | A1 * | 11/2012 | Hu | F41A 21/12 124/83 |
| 2013/0247893 | A1 * | 9/2013 | Yang | F41B 11/55 124/74 |
| 2014/0007857 | A1 * | 1/2014 | Schlosser | F41A 21/04 124/81 |
| 2015/0059721 | A1 * | 3/2015 | Huang | F41A 21/12 124/27 |

FOREIGN PATENT DOCUMENTS

| | | |
|---|---|---|
| JP | H10-220994 | 8/1998 |
| JP | 2005-121358 | 5/2005 |
| JP | 2014-202432 | 10/2014 |
| JP | 2014202432 A * | 10/2014 |

* cited by examiner

SIGHT ADJUSTMENT DEVICE IN SIMULATION GUN

TECHNICAL FIELD

The present invention relates to a sight adjustment device, which adjusts a course of a bullet to be shot when shooting the bullet loaded in a cartridge portion of each of barrels, in a simulation gun having a plurality of the barrels.

BACKGROUND ART

Simulation guns include airsoft guns. The airsoft guns are generally classified into electric guns, gas guns, and air cocking guns. The electric guns are electrically operated airsoft guns in which a piston for compressing air is electrically operated. The gas guns are airsoft guns which vigorously jet out gas compressed in a tank and fly an airsoft pellet. The gas guns are operated by using dedicated gas. In the air cocking guns, a piston for compressing air is manually operated. Some airsoft guns include a hop adjustment device which can adjust a trajectory, that is, a course of an airsoft pellet.

A bullet called an airsoft pellet is used in the airsoft guns. However, the airsoft pellet is classified by weight, such as 0.12 g, 0.2 g, and 0.25 g. When airsoft pellets being different from each other in weight are used in an airsoft gun, it is ideal for the strength of a backspin (degree of an applied backspin) to match the weights of the airsoft pellets. In addition, when airsoft pellets being different from each other in weight are used in one airsoft gun, it is desirable for the strength of a backspin degree of an applied backspin to match the weights of the airsoft pellets. When a backspin is applied to an airsoft pellet and the airsoft pellet is shot, force tending to rise is generated in the airsoft pellet. When force of the airsoft pellet tending to fall due to the force of gravity, and force thereof tending to rise due to a backspin are balanced, it is possible to fly the airsoft pellet straight farther with a smaller air quantity than when being shot without any aid. Hereinabove, an overview of an adjustment device called a trajectory system has been described.

JP-A-6-3091 is an invention which relates to the sight adjustment device and claimed by the applicant of this application. The invention of JP-A-6-3091 has a configuration in which an opening is formed in an upper portion of a gun cavity for shooting a spherical bullet, a frictional member being able to protrude into the gun cavity is disposed therein, and a pressing member pressing the frictional member from the outside in a direction toward the inside of the gun cavity is provided together with a friction adjustment mechanism. In addition, JP-A-2005-121358 discloses an invention which relates to a course calibration device which calibrates a course of a bullet coming out from a gun barrel of a replica of a weapon. The course calibration device includes a first pin that forms a first boss for holding a bullet inside the gun barrel, and a second pin that forms a second boss for holding the bullet inside the gun barrel. The first and second pins are positioned so as to be bilaterally symmetric about a vertical axis passing through the center of the gun barrel. As seen in the configuration, all the trajectory systems in the related art aim to perform a sight adjustment in a simulation gun having a single barrel, and other types of trajectory systems are not known.

In contrast, when developing a simulation gun having a plurality of barrels, there is a problem regarding a way of performing a sight adjustment of the plurality of barrels. Even in the simulation gun having a plurality of barrels, the configuration having a simple trajectory system is known from those in the related art. However, it is not possible to adjust the strength of a trajectory. It is possible to consider that the invention relating to the sight adjustment device is applied to the simulation gun having a plurality of barrels. However, the invention of PTL 1 employs an adjusting method in which a holding cylinder fitted to a barrel is moved back and forth. In order to perform a sight adjustment, there is a need to develop a mechanism for moving a plurality of the holding cylinders. In the invention of PTL 2, two pins, that is, the first and second pins are required for a sight adjustment, leading to a problem in that both the mechanism and the adjustment method become excessively complicated when being applied to the plurality of barrels.

CITATION LIST

Patent Literature

[PTL 1] JP-A-6-3091
[PTL 2] JP-A-2005-121358

SUMMARY OF INVENTION

Technical Problem

The present invention has been made in consideration of the foregoing points, and an object thereof is to provide a sight adjustment device, which can easily and reliably execute an adjustment of a trajectory of a bullet loaded in a cartridge portion, in a simulation gun having a plurality of barrels. In addition, another object of the present invention is to be able to obtain an optimal trajectory under conditions of different bullet types, temperatures, and the like, in the simulation gun having a plurality of barrels.

Solution to Problem

In order to attain the above-described objects, according to the present invention, there is provided means for a sight adjustment device, which adjusts a course of a bullet to be shot when shooting the bullet loaded in a cartridge portion of each of barrels, in a simulation gun having a plurality of the barrels. The sight adjustment device includes a plurality of pressurization members that add pressure to the bullet loaded in each cartridge portion such that rotation is applied to each bullet; a link member that is provided on a side of a gun main body such that one end portion is disposed on a side of the pressurization members and the other end portion is disposed on a side of an operation unit, and transmits an operation of the operation unit to the pressurization members; and the operation unit that is provided on the side of the gun main body in order to adjust a trajectory amount.

The present invention relates to the sight adjustment device targeted at a simulation gun having a plurality of barrels. As described above, a trajectory system basically aims to balance between force of an airsoft pellet tending to fall due to the force of gravity, and force thereof tending to rise due to a backspin, to fly the airsoft pellet straight farther than when being shot without any aid, and to consequently improve hit precision, that is, to ameliorate a flying distance, straightness, and a hit rate. However, in a case of bullets shot from the plurality of barrels, for example, dispersion of the bullets can be adjusted by adjusting the trajectory. Thus, the present invention is not limited to so-called backspin, and changing the trajectory is also included in the object.

The sight adjustment device of the present invention includes the plurality of pressurization members that applies rotation to a plurality of bullets, the link member that transmits an operation of the operation unit to the pressurization members, and the operation unit that adjusts the backspin amount. Among thereof, in order to apply rotation to each bullet by adding pressure to the ballet loaded in each cartridge portion, one pressurization member for one barrel, that is, the plurality of pressurization members in total are generally prepared.

In the present invention, if is preferable that the pressurization members are each disposed at least in upper portions of the plurality of barrels in order to apply upward rotation to the bullet and are configured to have pressurization projections which come into contact with the bullet at an upper portion of the cartridge portion. Since the pressurization members are disposed in the upper portions of the barrels, it is necessary to have the configuration in order to achieve a function as the so-called backspin.

The link member is provided on the side of the gun main body such that the one end portion is disposed on the side of the pressurization members and the other end portion is disposed on the side of the operation unit, and transmits an operation of the operation unit to the pressurization members. Therefore, when a plurality of the link members are prepared, it is possible to dispose each of the one end portions in sites of the plurality of pressurization members and to bind and dispose each of the other end portions in one place in the gun main body.

In the present invention, it is preferable that the operation unit includes fine adjustment means for allowing an operation amount to be subjected to a fine adjustment and is configured to include a multi-spiral engagement portion which is provided in a rotary-type operation piece so as to serve as the fine adjustment means, and an engagement counterpart portion which is provided in the other end portion of the link member and is able to engage with the engagement portion. When the multi-spiral engagement portion and the engagement counterpart portion in the other end portion of the link member engage with each other, the operation amount (input) in a circumferential direction in which the operation piece rotates is converted into an adjustment amount (output) in a radial direction. Therefore, it is possible to suitably adjust slight pressurization force.

The operation unit is provided on the side of the gun main body in order to adjust the backspin amount. A plurality of the link members and a plurality of the operation units may be provided so as to respectively correspond to the plurality of pressurization members and each of the link members and the operation units may be configured to be able to be independently operated and adjusted. That is, the configuration is provided for the plurality of pressurization members to be independently operated by the plurality of operation units. In other words, when only one link member and one operation unit are provided with respect to the plurality of configuration in which all the pressurization members can be operated and adjusted by one operation unit.

In the present invention, it is preferable that the link member is configured to include a push member which is provided so as to be movable in a vertical direction and of which a lower portion comes into contact with the pressurization members, and a rotatable lever of which one end portion is joined to an upper portion of the push member, of which the other end portion communicates with the operation unit, and which is pivotally supported between both the end portions.

Advantageous Effects of Invention

Since the present invention is configured and operates as described above, when the plurality of pressurization members and the plurality of operation units are joined to each other by using the link member in the simulation gun having a plurality of barrels, the operation units are bound in one place, thereby exhibiting the effect that an adjustment of the trajectory of a bullet loaded in the cartridge portion can be easily and reliably executed. In addition, according to the present invention, the trajectory of a bullet shot from each barrel can also be adjusted in the simulation gun having a plurality of barrels, thereby exhibiting the effect that a sight adjustment can be performed in accordance with conditions of different bullet types, temperatures, and the like.

BRIEF DESCRIPTION OF DRAWINGS

FIG. 4 consists of FIGS. 4A and 4B and illustrates the cylinder assembly used in the simulation gun according to the invention.

FIG. 7 consists of FIGS. 7A, 7B and 7C and illustrates a cartridge assembly in which the sight adjustment device according to the present invention is embedded.

FIG. 9 consists of FIGS. 9A and 9B and illustrates rear end portions of barrels.

FIG. 10 consists of FIGS. 10A, 10B and 10C and illustrates the rear end portions of the barrels according to the invention.

FIG. 11 consists of FIGS. 11A and 11B and illustrates the same sight adjustment device according to the invention.

FIG. 12 consists of FIG. 12A, FIG. 12B and FIG. 12C and illustrates a state of an upper barrel when the sight adjustment device according to the present invention is not adjusted.

13A is a right-side view.

FIG. 14 consists of FIGS. 14A, 14B and 14C and illustrates a state of a lower left barrel when the sight adjustment device according to the present invention is not adjusted.

FIG. 15 consists of FIGS. 15A, 15B and 15C and illustrates a state of the lower left barrel when the sight adjustment device according to the present invention is adjusted.

FIG. 16 consists of FIGS. 16A, 16B and 16C and illustrates a state of a lower right barrel when the sight adjustment device according to the present invention is not adjusted.

FIG. 17 consists of FIGS. 17A, 17B and 17C and illustrates a state of the lower right barrel when the sight adjustment device according to the present invention is adjusted.

REFERENCE NUMBERS

10 Compressed Air Generating Unit
11, 12, 13 Barrel
14 Cartridge Portion
15 Sight Adjustment Device
16 Connection Gasket
18 Switch
19 Outer Barrel
20 Cylinder Assembly
21, 22, 23 Cylinder
24 Blast Nozzle
25 Pipe Member
26 Front Fixing Member
27 Rear Fixing Member
28 Inter-Nozzle
29 Nozzle Base
30 Piston Assembly
31, 32, 33 Piston
34 Joint Portion
35 Piston Shaft
36 Rack
37 Rod
38 Seal Member
39 Gear Disposition Space
40 Electric Mechanism
41 Output Gear
42 Elastic Member
43 Electric Motor
44 Pinion
45 Reduction Gear Set
46 Piston Movement Portion
47 Guide Groove
48 Selector
49 Latch Member
50 Cartridge Assembly
51 Magazine
53 Bullet Supply Unit
54 Receiving Member
55 Switching Mechanism
57 Opening
58*a*, 58*b* Cover
60 Cartridge Portion Housing
61, 62, 63 Pressurization Member
64, 65, 66 Link Member
67, 68, 69 Operation Unit
70 Fine Adjustment Means
71, 72, 73 Push Member
74, 75, 76 Lever
77, 78, 79 Dial

DETAILED DESCRIPTION OF THE INVENTION

Figure 1:
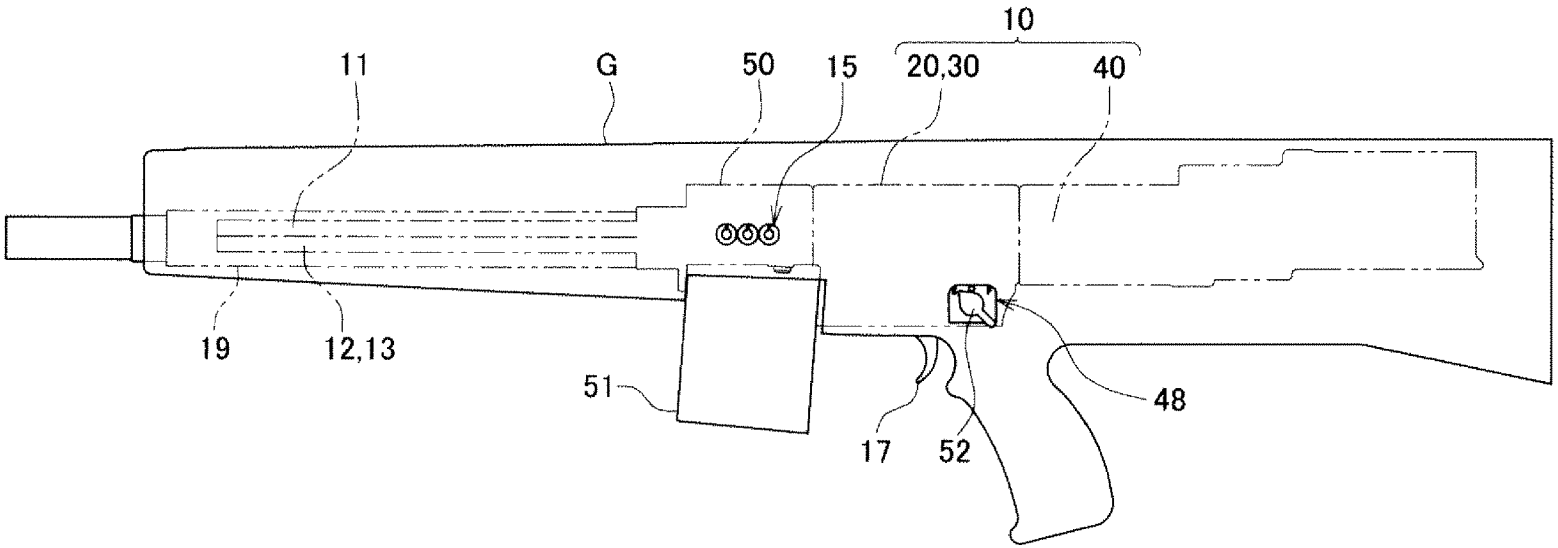
FIG. 1 is a side view illustrating an example of a simulation gun in which a sight adjustment device according to the present invention is applied.

Hereinafter, with reference to the illustrated embodiment, the present invention will be described in more detail. FIG. 1 is a general view of a simulation gun in which a sight adjustment device of the present invention is applied. The simulation gun is a long barreled-type multi-bullet shooting electric gun G. The electric gun G has three barrels 11, 12, 13. Therefore, a compressed air generating unit 10 is configured to have a cylinder assembly 20 constituted by three cylinders 21, 22, 23, a piston assembly 30 constituted by three pistons 31, 32, 33, and an electric mechanism 40 driving the piston assembly 30.

Figure 2:
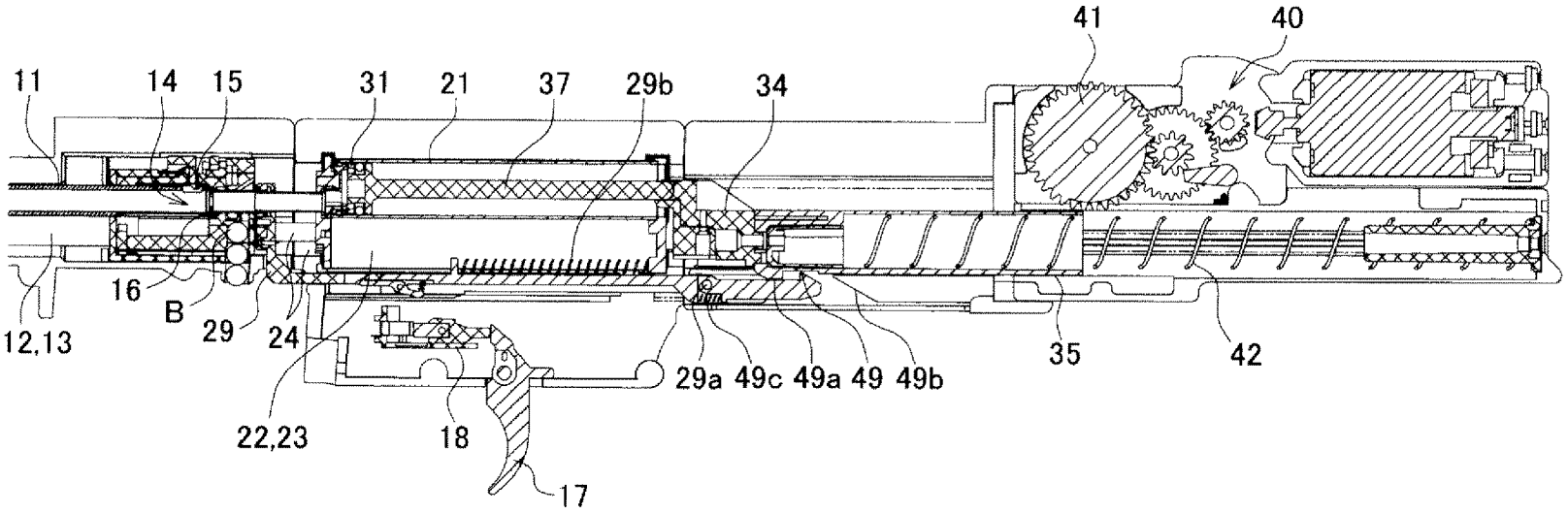
FIG. 2 is a sectional view illustrating an enlarged main portion of the simulation gun in which the sight adjustment device according to the invention is applied.

A cartridge assembly 50 is provided in a rear portion of the barrels, and a detachable magazine 51 is mounted at a lower portion thereof. A cartridge portion 14 is set in the cartridge assembly 50, so that a bullet B is disposed inside the rear end of each of the three barrels 11, 12, 13. The cartridge portion 14 is provided with a sight adjustment device 15 for adjusting a trajectory (FIG. 2). A connection gasket 16 covers the outside of the rear ends of the three barrels 11, 12, 13. The connection gasket 16 is formed of a soft material such as rubber, having seal performance.

The compressed air generating unit 10 is a part generating air with which the bullet B is blasted in order to shoot each bullet B from each of the barrels 11, 12, 13 in the multi-bullet shooting electric gun G. The barrels themselves are combined such that three thereof form a triangle shape when seen from the front. The compressed air generating unit 10 is disposed at the rear inside the electric gun G. The cylinder assembly 20, the piston assembly 30, and the electric mechanism 40 configuring the compressed air generating unit 10 are disposed in an approximately straight line in order thereof.

Figure 3:
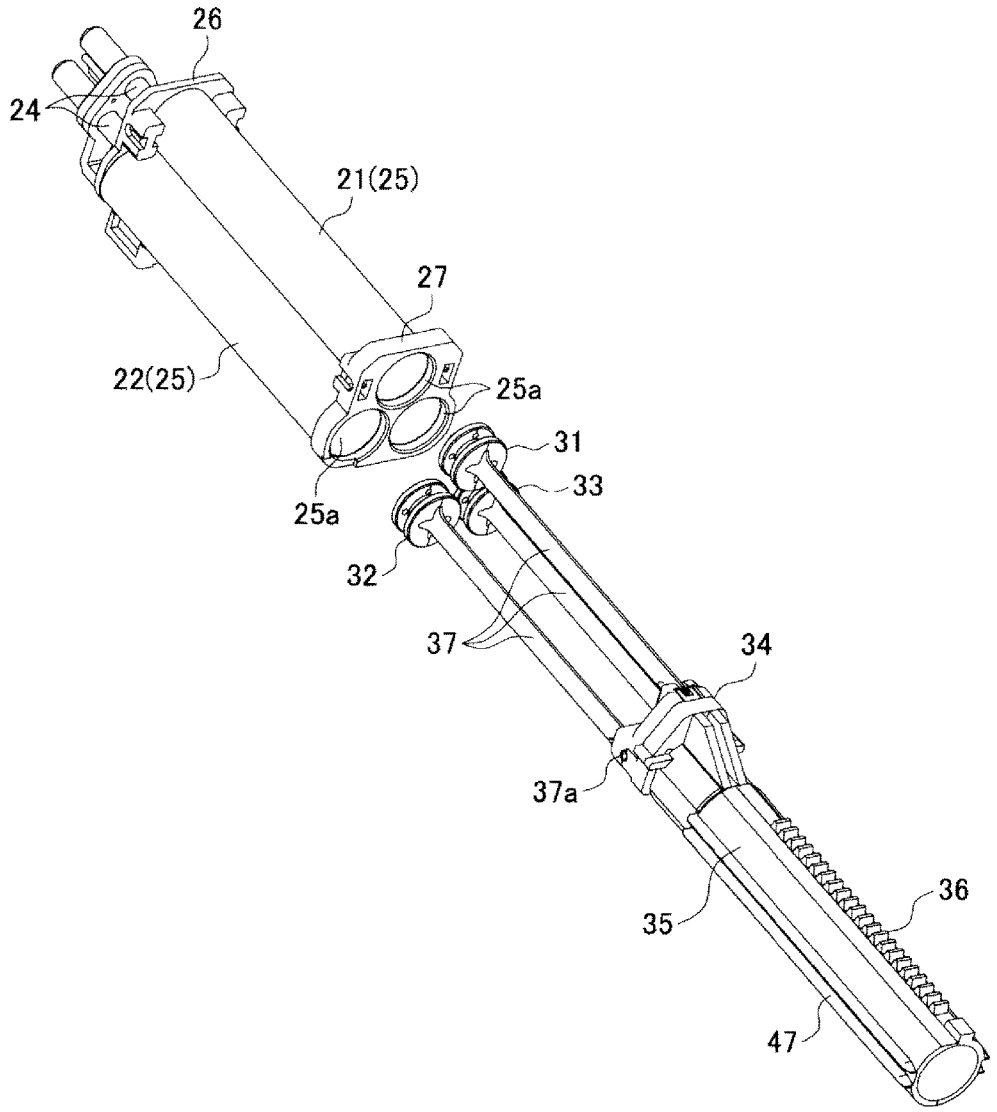
FIG. 3 is an exploded perspective view illustrating a cylinder assembly and a piston assembly used in the simulation gun according to the invention.

The cylinder assembly 20 is positioned in a rear portion of the three barrels 11, 12, 13, has an air-blast nozzle 24 at a tip end, and has the three cylinders 21, 22, 23 in which the pistons 31, 32, 33 respectively reciprocate. The illustrated cylinder assembly 20 is configured to have three pipe members 25, a front fixing member 26 fixing each of the pipe members 25 to a tip end portion, and a rear fixing member 27 fixing each of the pipe members 25 to a rear end portion (refer to FIGS. 3 and 4).

Figure 4A:
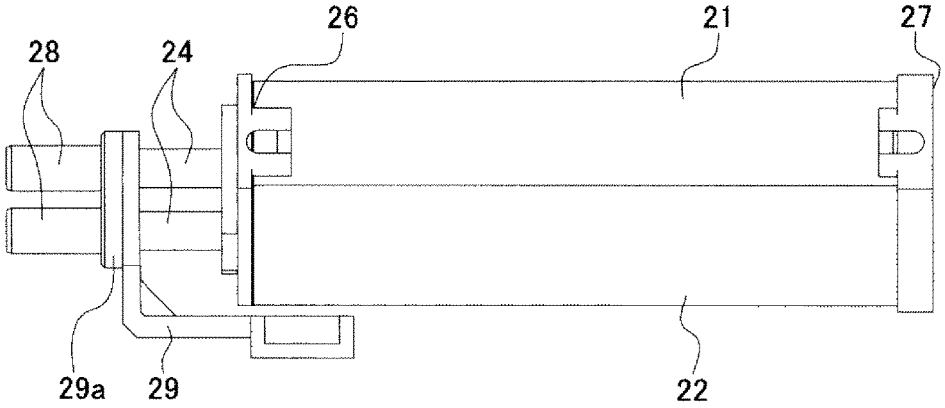
FIG. 4A illustrates a side view.
Figure 4B:
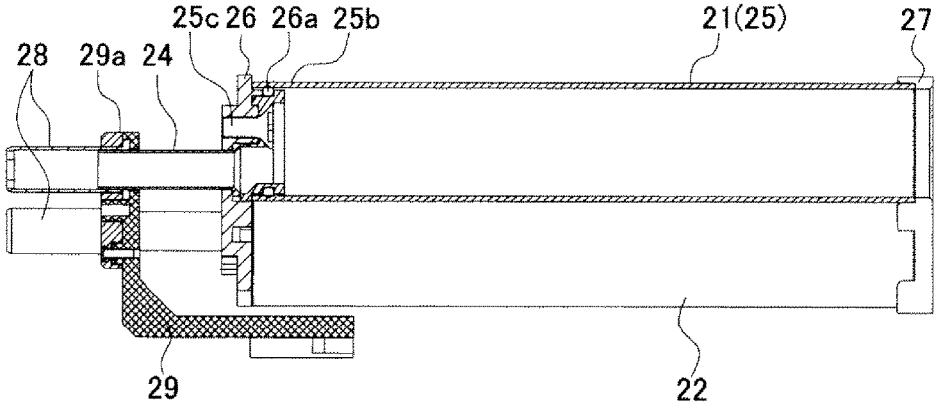
FIG. 4B illustrates a longitudinal sectional view taken along a central line.

The air-blast nozzle 24 is provided in the front fixing member 26, and an insertion port 25*a* for the piston is open in the rear fixing member 27. A blast nozzle 24 is provided in front of a pipe attachment member 25*b*, and the pipe attachment member 25*b* is attached to the rear surface of the front fixing member 26 by a fastener 25*c*. The pipe attachment member 25*b* has a positional relationship with the pipe member 25 in which the pipe attachment member 25*b* is fitted, and is assembled in an air-tight manner by using seal means 26*a* (FIG. 4).

As seen in the illustrated embodiment, an inter-nozzle 28 is connected to the cartridge portion 14 and the air-blast nozzle 24 and is provided to be movable in the forward-rearward direction by a nozzle base 28. The inter-nozzle 28 slides with respect to the blast nozzle 24 in an air-tight manner and is at a position where a bullet is blasted with compressed air generated in the compressed air generating unit 10. The inter-nozzle 28 is attached to an erected portion 29*a* of the nozzle base 29 and is incorporated in a main body of the simulation gun G so as to be able to advance and retract.

Therefore, the inter-nozzle 28 retracts by being engaged with a latch member 49 described below, in response to retract operations of the pistons 31, 32, 33 and is caused to advance by a spring of biasing means 29*b* acting on the nozzle base 29 (refer to FIG. 2). Then, the tip end thereof is configured to also slide with respect to the connection gasket 16 in an air-tight manner, to be separated from the connection gasket 16, and to retract so as to ensure a gap in which the bullet B is pushed up in the rear end portion of the barrel. Thereafter, the inter-nozzle 28 advances so as to push the bullet B into the cartridge portion 14.

The air-blast nozzle 24 is provided at a position leaning to the center of the pipe members 25, 25, 25 of the three cylinders 21, 22, 23. This countermeasure is provided because the air-blast nozzle 24 cannot coincide with the center of a cylinder pipe having a diameter larger than the barrel, since the number of a plurality of the barrels 11, 12, 13 in the illustrated example is three. Thus, the position of the air-blast nozzle 24 is determined based on the relationship between the barrel and the position of the center of the cylinder pipe.

Figure 5:
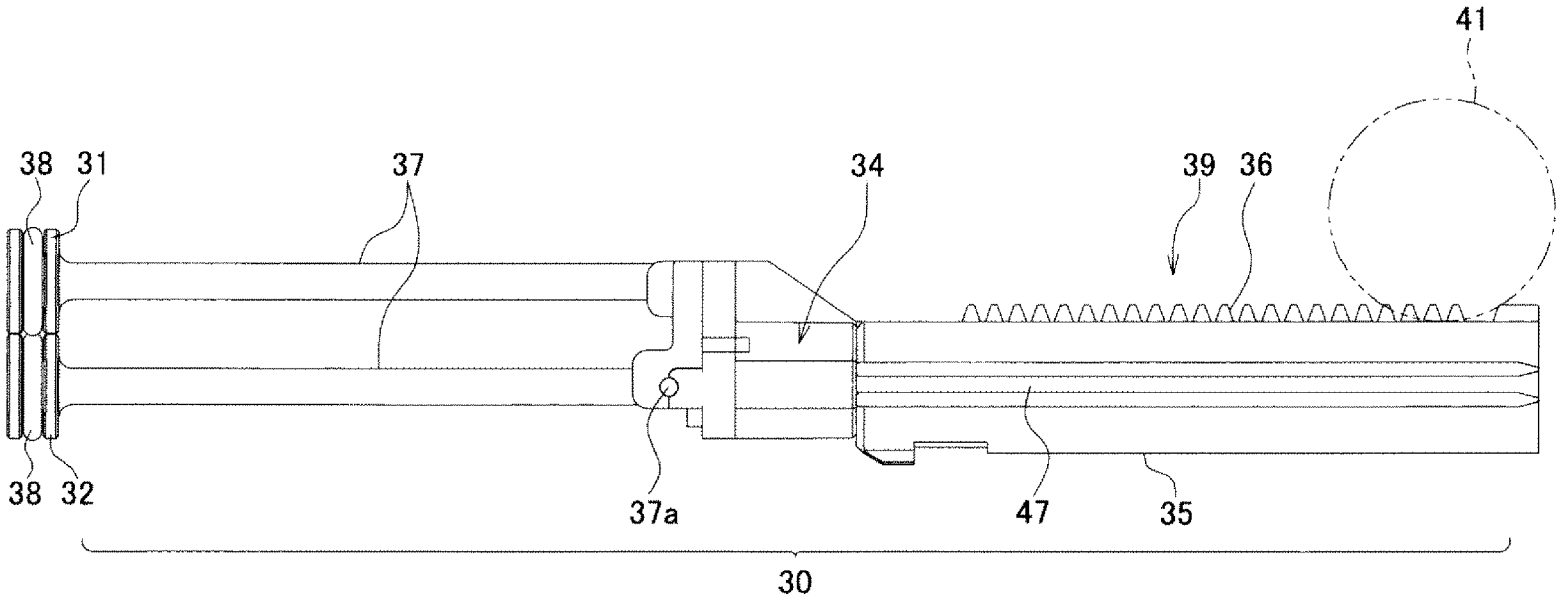
FIG. 5 is a side view illustrating the piston assembly according to the invention.

The piston assembly 30 has the three pistons 31, 32, 33 which respectively reciprocate inside the cylinders 21, 22, 23 and generate compressed air. In addition, the three pistons 31, 32, 33 are configured to be bound in one place by a joint portion 34 at the rear and to be integrally provided with one piston shaft 35 having a rack 36 along a reciprocating direction and the joint portion. (refer to FIG. 5).

The three pistons 31, 32, 33 are flexibly joined to the joint portion 34 such that seal performance between the pistons 31, 32, 33 and cylinder inner wall surfaces is maintained due to the joined state. That is, when the pistons and the cylinders configuring a piston cylinder mechanism have high precision in the positional relationship or the fitting state therebetween, it becomes easy to obtain high compressibility. Moreover, the axial centers therebetween also have to coincide with each other with high precision. However, when a certain degree of flexibility is allowed, it is possible to obtain high compressibility without requiring excessive precision.

In order to apply the flexibility, the present invention employs a configuration in which the pistons 31, 32, 33 are provided at the tip end of slender rods 37 so as to be movably pivoted by the joint portion 34 sit the rear of the rods 37. In the configuration of the illustrated embodiment, the rods 37 are pivoted with respect to the reciprocating direction of the pistons by using a pivot 37*a* in the transverse direction such that the rods 37 become movable in the vertical direction. The air-tightness of the pistons 31, 32, 33 is maintained by using the illustrated O-rings as seal members 38.

In the configuration of the embodiment in which the piston cylinder mechanism is constituted by three sets, as described above, the three sets are combined in the piston assembly 30 so as to have a triangle shape when seen from the front, the piston shaft 35 is disposed in the joint portion 34 with a positional relationship of being shifted downward from a central portion of the three sets, and the rack 36 is positioned at the top of a part which is shifted downward. Therefore, the position of the rack 36 becomes close to the central portion of the three sets. Accordingly, it is possible to gain a disposition space 39 for the electric mechanism 40 of an output gear 41, and driving force of the output gear 41 is more efficiently transmitted from a position close to the center line.

Figure 6:
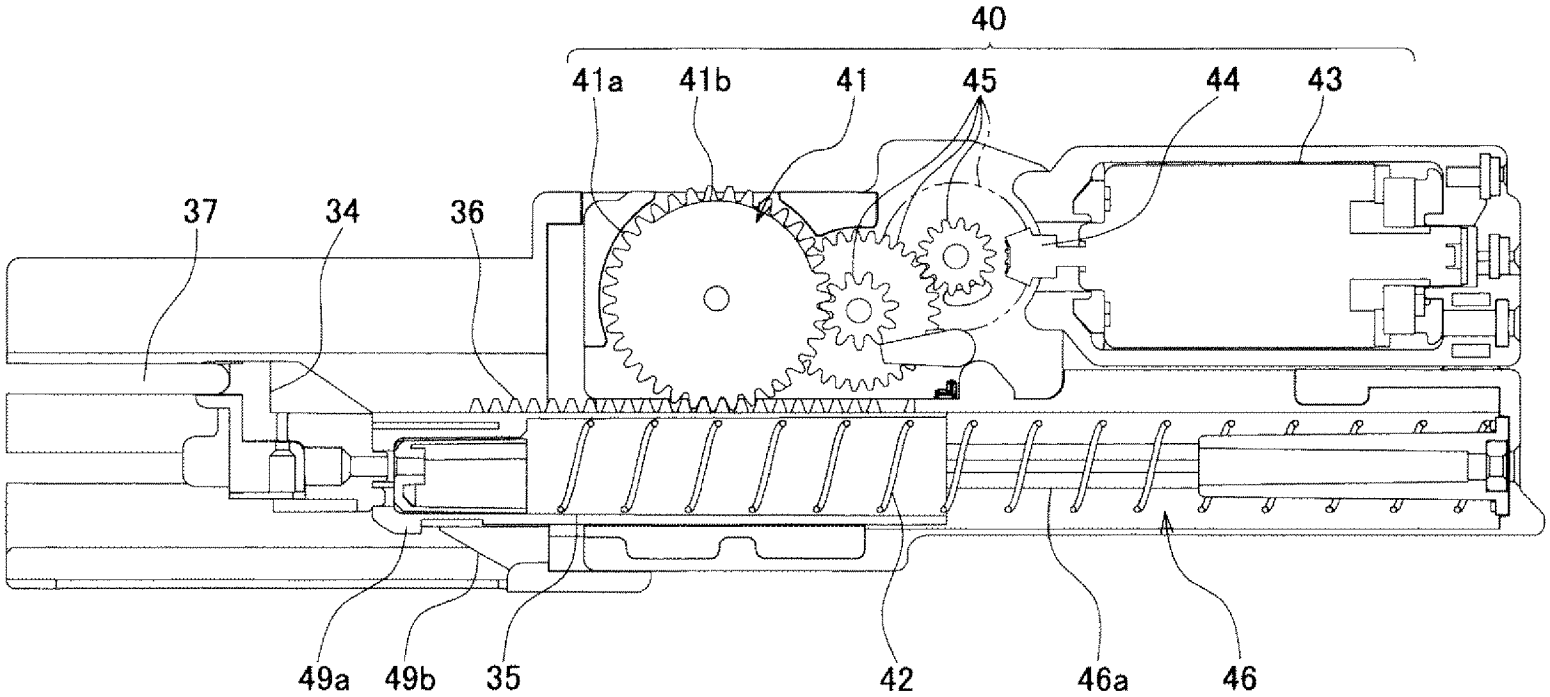
FIG. 6 is a view illustrating an electric mechanism according to the invention.

The electric mechanism 40 is configured to cause the piston assembly 30 to retract, to cause an elastic member 42 to accumulate pressure, and to drive the output gear 41 meshing with the rack 36 in order to compress air by releasing the accumulated pressure. As a description with reference to FIG. 6 in detail, the reference number 43 indicates an electric motor, that is, a motor, the reference sign 44 indicates a pinion attached to a rotary shaft thereof, and the reference number 45 indicates a reduction gear set constituted by several gears meshing with the pinion 44. The output gear 41 is constituted by a sector gear. The sector gear 41 has a toothed portion 41*a* which meshes with the rack 36 and causes the piston assembly 30 to retract, and a non-toothed portion 41*b* which does not mesh with the rack 36 and enables the piston assembly 30 to advance.

The piston shaft 35 has a hollow structure and is biased in the advancing direction by the elastic member 42 illustrated as a coil spring which is hollow inside. One end of the elastic member 42 constituted by the coil spring is in contact with the front end of the piston shaft which is hollow inside, and the other end is supported by the rear end of the cavity which is a movement portion 46 for the piston provided inside the electric mechanism 40. The reference number 47 indicates a guide portion constituted by an irregular structure. The guide portion 47 is provided, in a laterally longitudinal direction of the piston shaft 35 and engages with a projection 46*a* which is an engagement counterpart constituted by an irregular structure provided on the gun main body side, thereby functioning as a guide for moving straight forward (refer to FIG. 6).

In addition to the description above, the multi-bullet shooting electric gun G of the embodiment includes mechanisms required for operating as an electric gun, such as a power source battery (not illustrated), a circuit connecting the power source battery and the electric motor 43, and a switch for turning on and off the power source. The reference number 18 indicates the switch, the reference number 19 indicates an outer barrel housing the three barrels, the reference number 48 indicates a selector for selecting a shooting mode, and the reference number 49 indicates the aforementioned latch member. The latch member 45 is pivoted at the rear end of the nozzle base 29 by a pivot 29*a* as vertically movable engagement means. The latch member 49 is configured to be retractable by being engaged with an engagement counterpart portion 49*a* provided in the piston shaft 35 and to be able to be disengaged by coming into contact with a disengagement portion 49*b* provided on the gun main body side. The reference number 49*c* is a spring, which is biasing the latch member 49 in a direction for engaging with the engagement counterpart portion 49*a* (refer to FIG. 2). The spring 29*b* is configured to act on the nozzle base 29 as forward biasing means so as to push out the supplied bullet B to the cartridge portion 14.

In the sight adjustment device 15 in a simulation gun of the present invention, an assembly is provided in a part of the cartridge assembly 50 positioned in the rear portion of the barrels (refer to FIG. 2). The detachable magazine 51 is mounted in a lower portion. Through a supply passage 51*a* connected to a ballet supply port thereof, the ballet B is pushed up one shot at a time and is supplied to a bullet supply unit 53. The bullet supply unit 53 is positioned at the rear end of the cartridge assembly 50 and internally has a receiving member 54 which receives the supplied bullet B. The receiving member 54 has three receiving portions 55 in total, that is, one at the top center and two at the lower right and left. The receiving member 54 is pushed downward by a spring 56 which is biasing means (refer to FIG. 7).

The bullet supply unit 53 is penetrated in the forward-rearward direction by openings 57 in three places. The tip end portion of the inter-nozzle 28 can be inserted into each of the openings 57. That is, the openings 57 in the three places are set such that the disposition thereof completely coincides with the cartridge portions 14 respectively positioned inside the three barrels at the rear end, and the receiving portions 55 in the three places. Therefore, in the configuration, when the inter-nozzle 28 advances, the ballets B pushed up by the receiving portions 55 in the three places can be respectively sent to the cartridge portions 14 in the rear portions of the three barrels 11, 12, 13.

Figure 8:
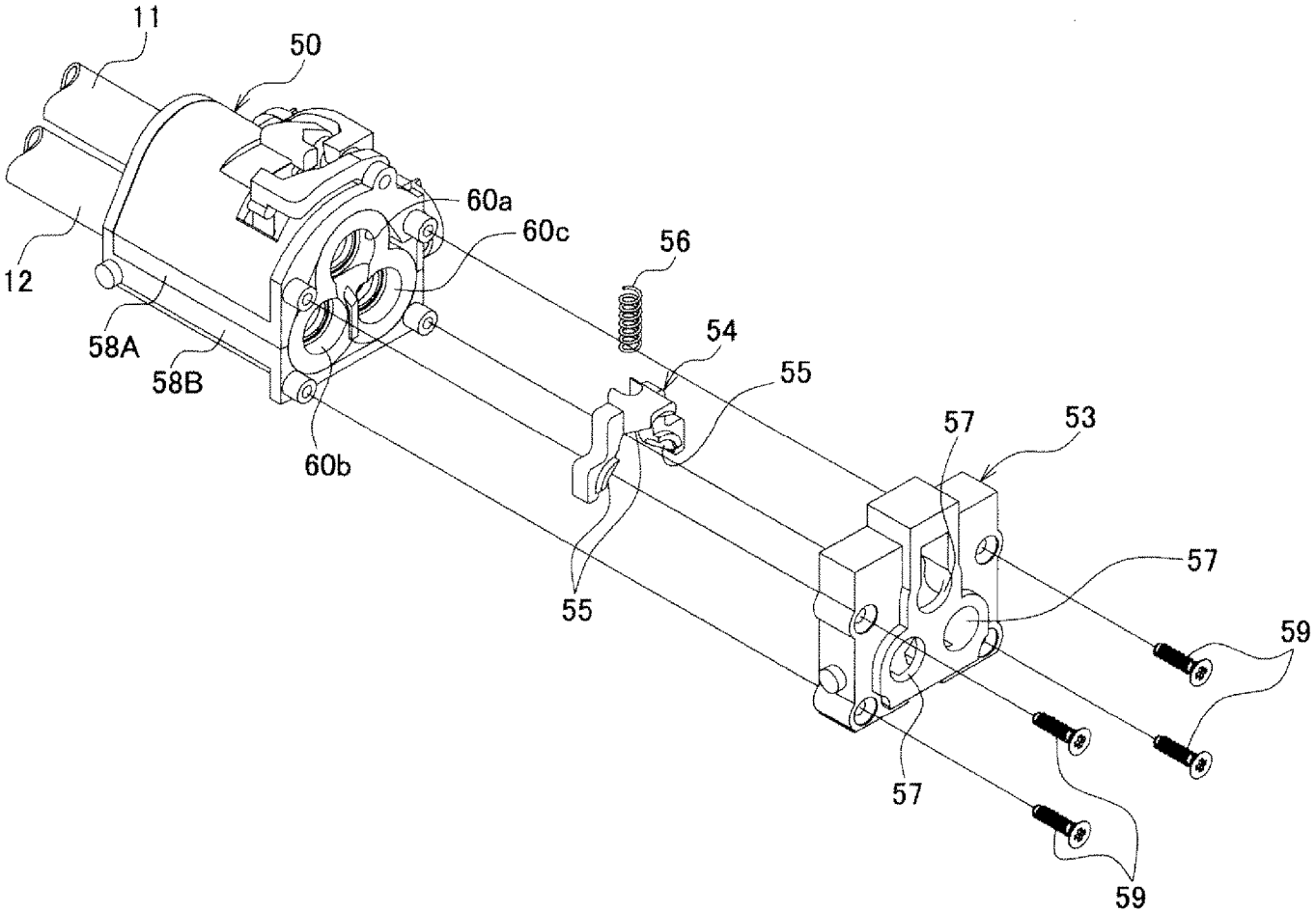
FIG. 8 is an exploded perspective view illustrating the cartridge assembly according to the invention.
Figure 9A:
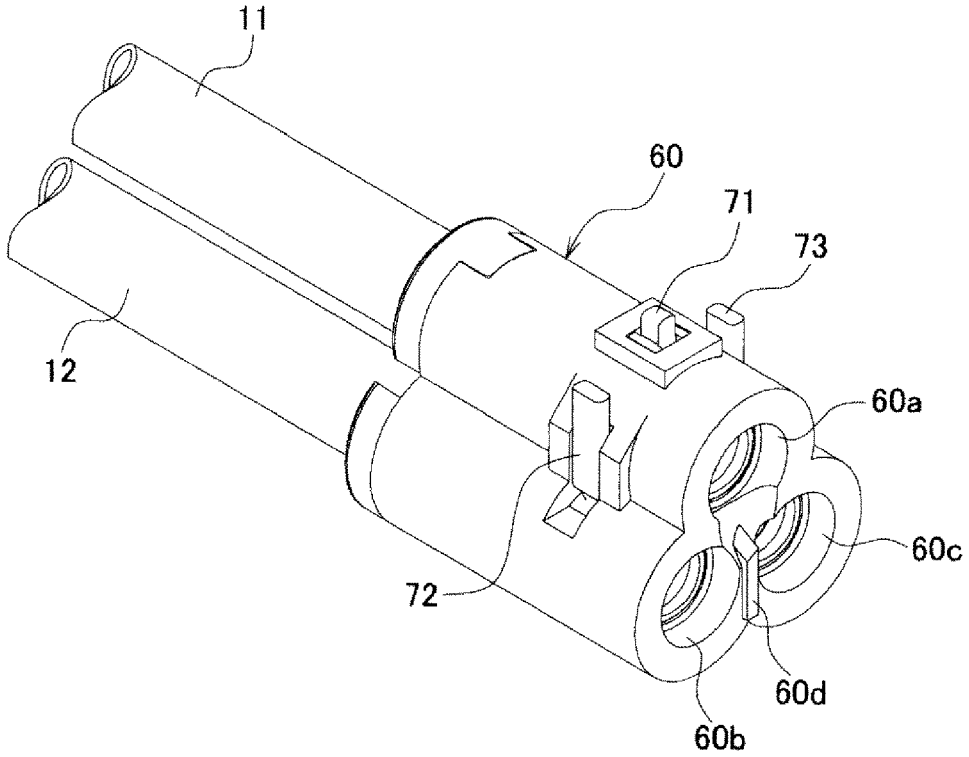
FIG. 9A is a perspective view.

In the illustrated example, the cartridge assembly 50 positioned at the rear end of the three barrels 11, 12, 13 has covers 58A, 58B constituted by two upper and lower members. In addition, the covers 58A, 58B and the bullet supply unit 53 are integrally assembled by a fastener 59 illustrated as a screw. As illustrated in FIGS. 7 to 9, the rear end portions of the covers 58A, 58B approximately coincide with the rear end portions of the three barrels 11, 12, 13. In the rear end portions of the barrels 11, 12, 13, there is provided a cartridge portion housing 60 surrounding the cartridge portions 14.

The cartridge portion housing 60 has the appearance in which three cylinders are bundled, and the rear end thereof forms openings 60*a*, 60*b*, 60*c* facing the bullet supply unit 53 via the receiving member 54. The reference number 60*d* indicates a straightening portion provided for the bullet B to be induced to the target cartridge portion 14. The three barrels 11, 12, 13 respectively occupy the ins ides of the cylinders. Therefore, a device for a sight adjustment is provided in this part (loading portion 14). The sight adjustment in the illustrated embodiment applies upward rotation to a bullet. Pressurization members 61, 62, 63 are each disposed in upper portions of the barrels 11, 12, 13 (FIG. 9B).

Figure 7A:
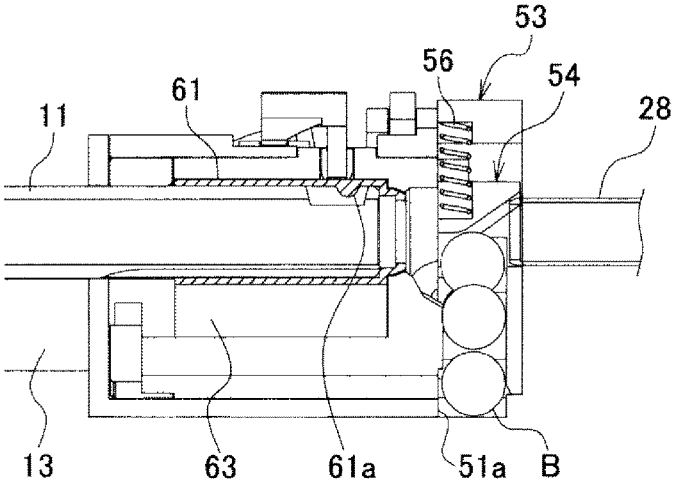
FIG. 7A is a longitudinal sectional view taken along the central line.
Figure 7B:
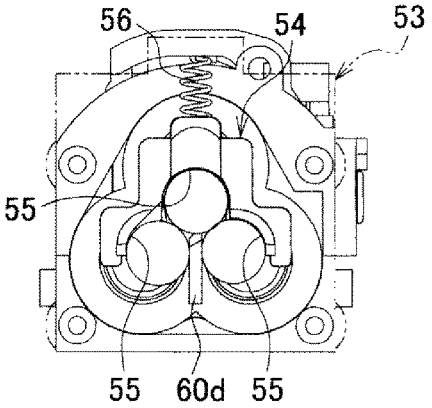
FIG. 7B is a rear view of the cartridge assembly from which a member of a bullet supply unit is removed.
Figure 7C:
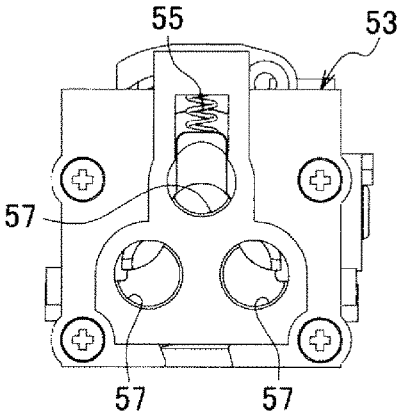
FIG. 7C is at rear view of the cartridge assembly.
Figure 9B:
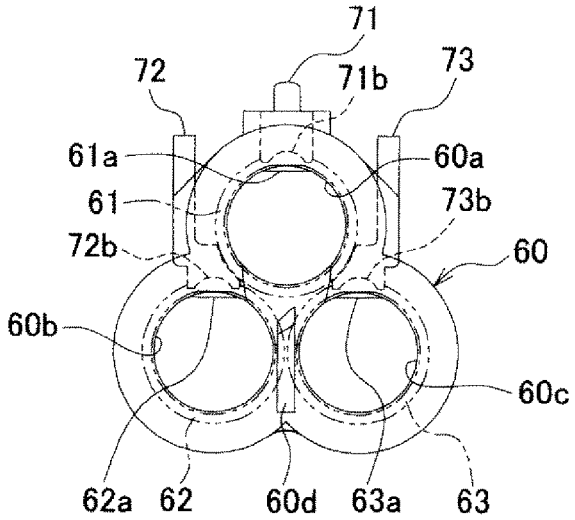
FIG. 9B is a cross-sectional view.
Figure 10A:
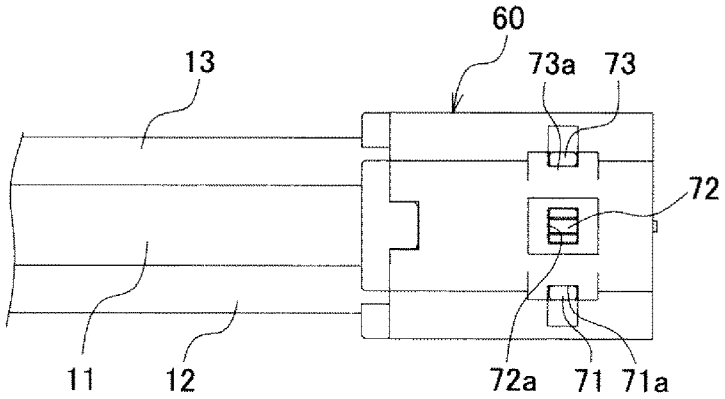
FIG. 10A is a top view.
Figure 10B:
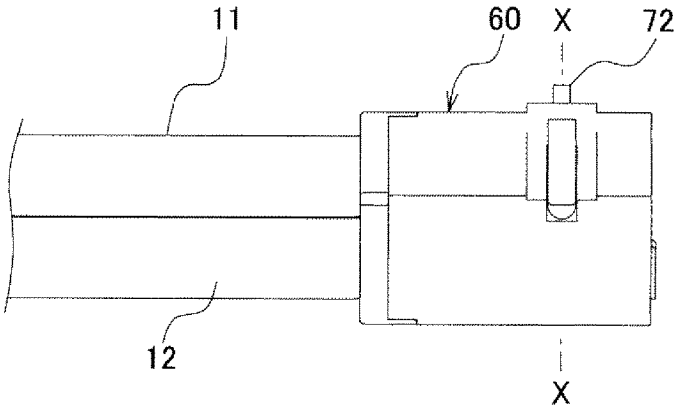
FIG. 10B is a left-side view.
Figure 10C:
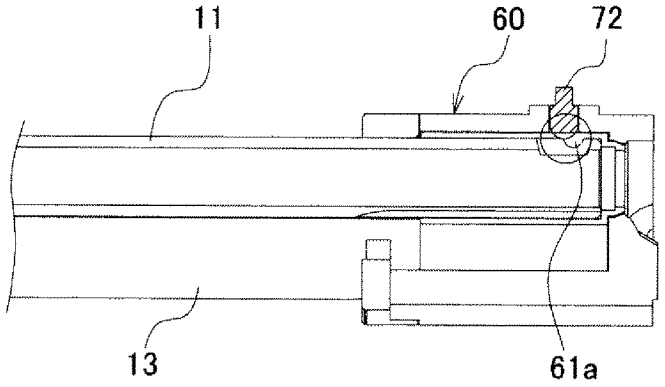
FIG. 10C is a longitudinal section taken along a central line.

The pressurization members 61, 62, 63 are formed of elastic materials called gaskets sometimes, have cylindrical shapes, and are respectively and partially (in the illustrated example, in an upper portion) provided with pressurization projections 61*a*, 62*a*, 63*a* which come into contact with the bullets B (refer to FIGS. 7A, and 9B). The embodiment illustrates an example in which a plurality of link members and a plurality of operation units are provided so as to respectively correspond to a plurality of the pressurization members, and each of the link members and the operation units is configured to be able to be independently operated and adjusted. Therefore, in order to transmit operations of operation units 67, 68, 69 to the pressurization members 61, 62, 63, link members 64, 65, 65 axe provided on a side of the gun main body such that one end portion is disposed on a side of the pressurization members 61, 62, 63 and the other end portion is disposed on a side of the operation units 67, 68, 69.

Similar to the three barrels 11, 12, 13, there are three pressurization members 61, 62, 63 in total, that is, one at the top center and two at the lower right and left. The operation units 67, 68, 69 are bound on one side (right side in the illustrated example) of the gun main body. For the communication thereof, there are provided the link members 64, 65, 66. The link members 64, 65, 66 are constituted by push members 71, 72, 73 which are provided so as to be movable in the vertical direction and of which lower portions come into contact with the pressurization members 61, 62, 63, and levers 74, 75, 76 of which one end portions are joined to upper portions of the push members 71, 72, 73 and of which the other end portions communicate with the operation units 67, 68, 69. The levers 74, 75, 76 are pivotally supported by shafts 74*a*, 75*a*, 76*a* as described below (refer to FIGS. 12C, 14C and 16C).

The push members 71, 72, 73 are configured to be inserted into guide holes 71*a*, 72*a*, 73*a* in the vertical direction formed in the cartridge portion housing 60 so as to be movable in only the vertical direction. Meanwhile, the levers 74, 75, 76 have configurations of levers which are attached so as to be rotatable about the shafts 74*a*, 75*a*, 76*a* between the one end portions and the other end portions. In a case of taking the configuration as a lever, the moment arm on a side of the point of force is shorter than that on a side of the point of action. Therefore, in the configuration, the output amount of the moment arm is greater than the input amount thereof in the levers 74, 75, 76, so that the amount of fine adjustment performed by using dials 77, 78, 79 is amplified. The push members 71, 72, 73 have arc-shaped convex portions 71*b*, 72*b*, 73*b* at lower ends. The convex portions 71*b*, 72*b*, 73*b* are provided so as to serve as means for providing the bullet B with an escape route in order to prevent bullet-clogging.

Figure 11A:
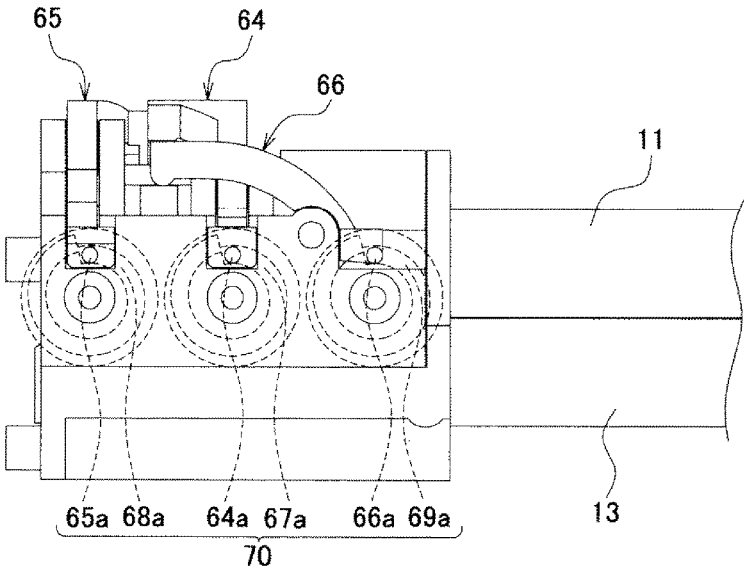
FIG. 11A is a right-side view schematically illustrating a fine adjustment mechanism.
Figure 11B:
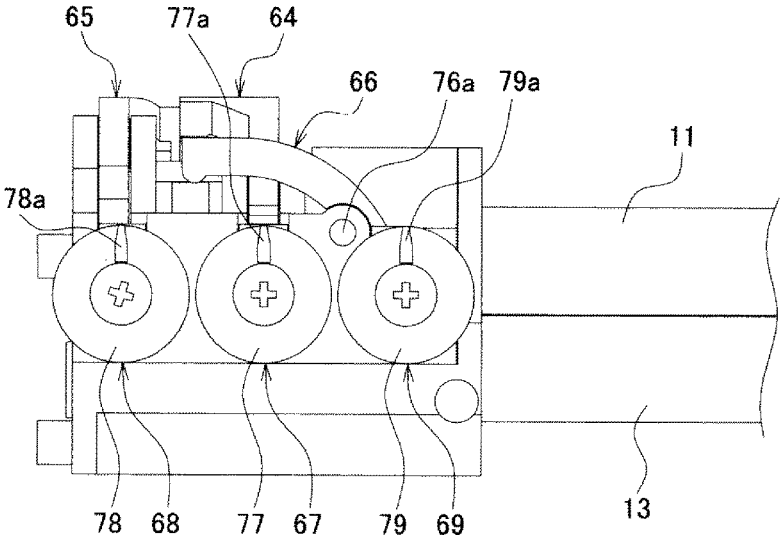
FIG. 11B is a view of the appearance of the same device.

In addition, the operation units 67, 68, 69 are configured to include fine adjustment means 70 for allowing an operation amount to be subjected to a fine adjustment. The fine adjustment means 70 in the embodiment is configured to include multi-spiral engagement portions 67*a*, 68*a*, 69*a* which are provided in rotary-type operation pieces, and engagement counterpart portions 64*a*, 65*a*, 66*a* which are provided in the other end portions of the link members 64, 65, 66 and are able to engage with the engagement portions (refer to FIG. 11A). Thus, the movement of the operation pieces in one rotation is a small amount as much as the component in the radial direction of the multi-spiral shape. Since the small amount of the movement is further transmitted to the pressurization members 61, 62, 63 via the levers 74, 75, 76, the sight adjustment can be precisely controlled. The operation pieces are constituted by the dials 77, 78, 79, and marks 77*a*, 78*a*, 79*a* indicating the operation amount are proved so as to face upward (refer to FIG. 11B).

Figure 12A:
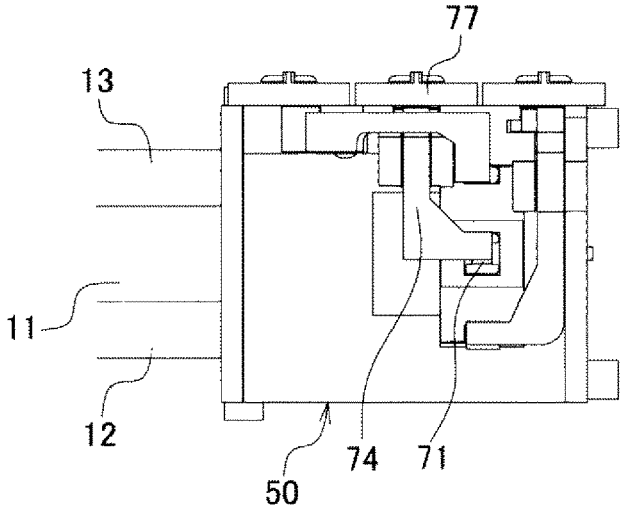
FIG. 12A is a top view.
Figure 12B:
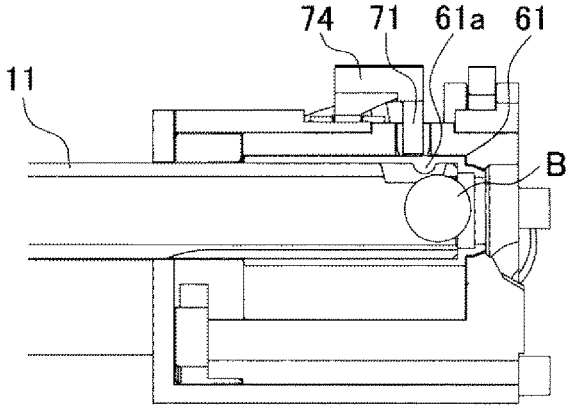
FIG. 12B is a longitudinal sectional view taken along the central line.
Figure 12C:
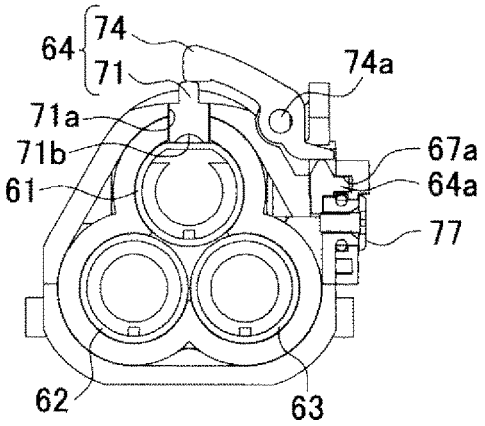
FIG. 12C is a cross-sectional view.
Figure 13A:
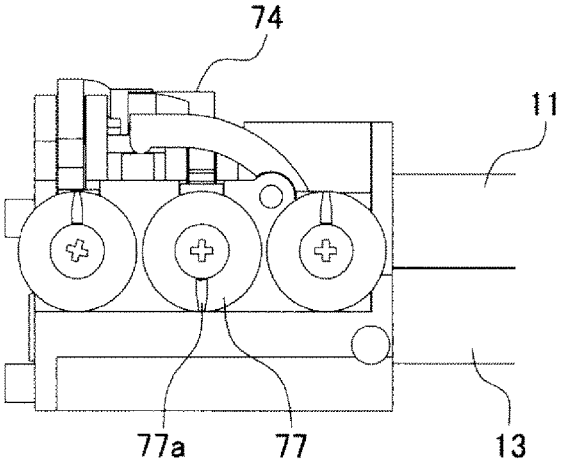
FIG. 13 consists of FIGS. 13A, 13B and 13C and illustrates a state of the upper barrel when the sight adjustment device according to the present invention is adjusted. FIG.
FIG. 13B is a longitudinal sectional view taken along the central line.
FIG. 13C is a cross-sectional view.
Figure 13B:
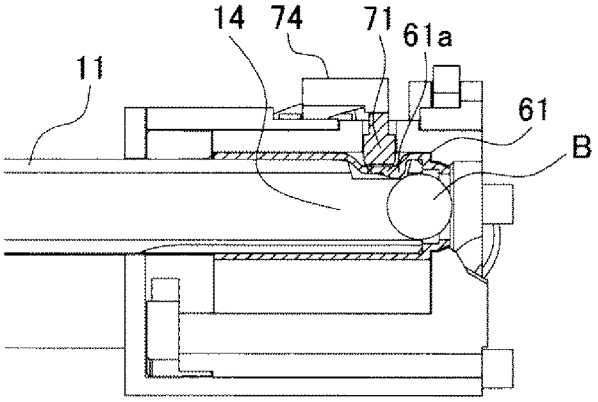
Figure 13C:
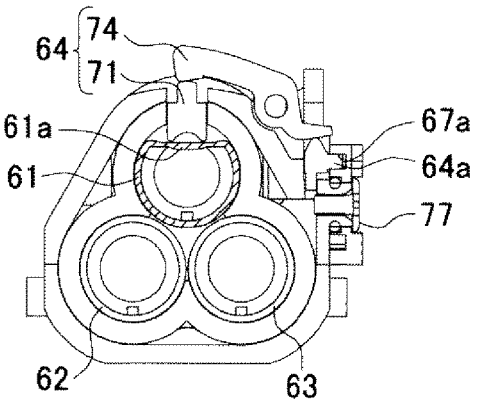

The sight adjustment device in a simulation gun of the present invention having such a configuration operates as follows. FIG. 12 illustrates a configuration relating to the sight adjustment in the upper barrel 11, that is, a state before an adjustment operation is performed. The push member 71, the lever 74, and the dial 77 correspond to the pressurization member 61 of the upper barrel 11. When the dial 77 is operated, the link member 64 operates in response to engagement between the engagement portion 67*a* and the engagement counterpart portion 64*a*. The pressurization projection 61*a* is pushed by the push member 71 and protrudes into the cartridge portion 14, or the protruding amount changes (FIG. 13B). The change of the protruding amount corresponds to the range of the sight adjustment amount, and the adjustment amount is indicated by the mark 77*a* (FIG. 13A).

Figure 14A:
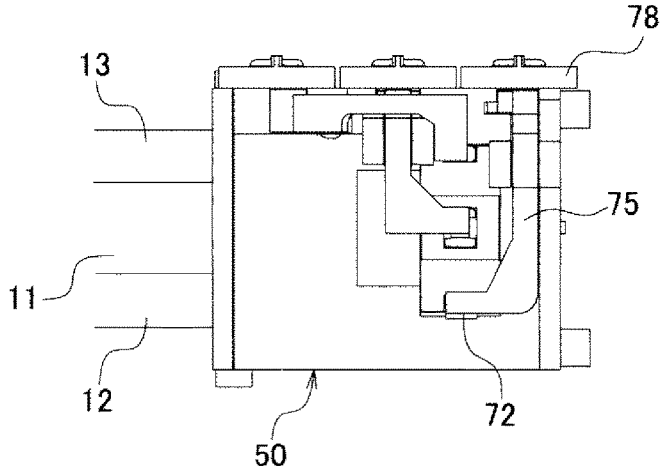
FIG. 14A is a top view.
Figure 14B:
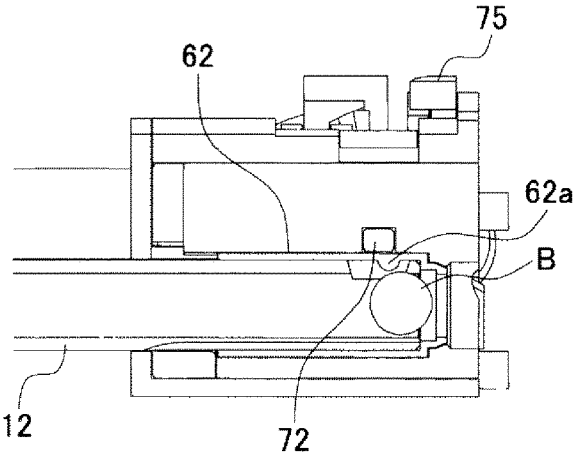
FIG. 14B is a longitudinal sectional view taken along the central line.
Figure 14C:
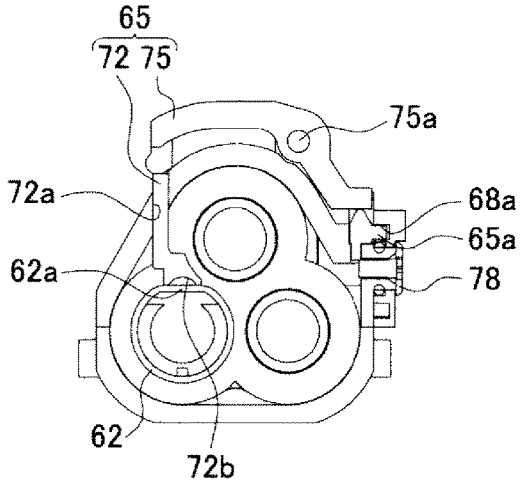
FIG. 14C is a cross-sectional view.
Figure 15A:
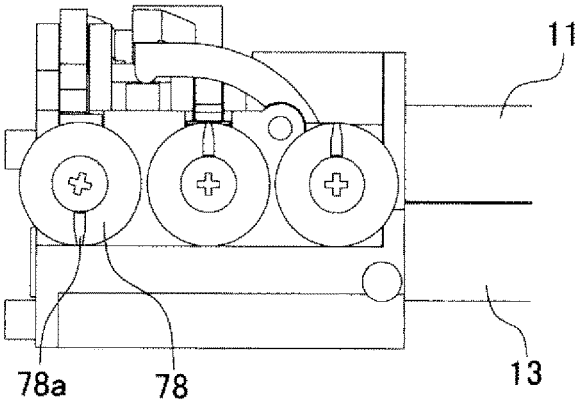
FIG. 15A is a right-side view.
Figure 15B:
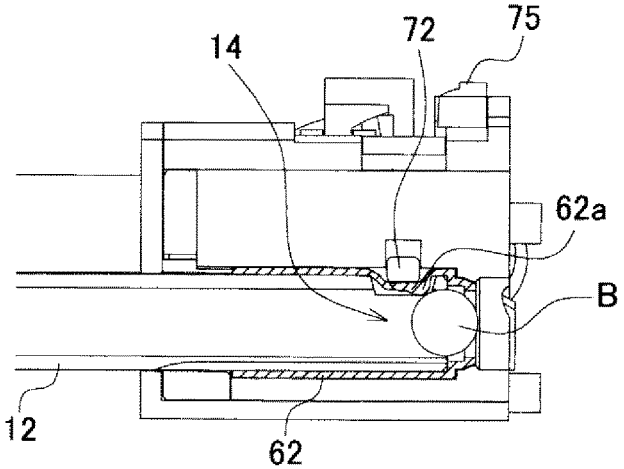
FIG. 15B is a longitudinal sectional view taken along the central line.
Figure 15C:
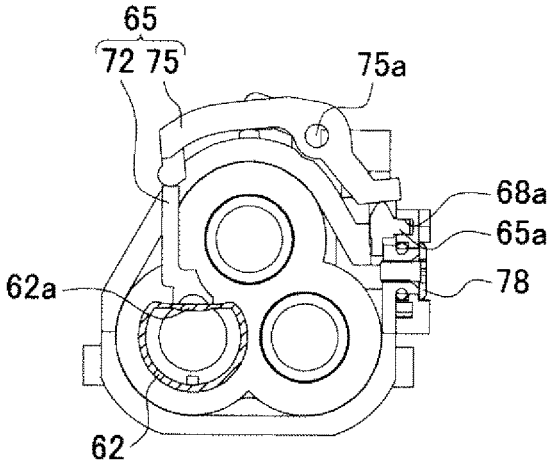
FIG. 15C is a cross-sectional view.

FIG. 14 illustrates a configuration relating to the sight adjustment in the left barrel 12, that is, a state before an adjustment operation is performed, similar to the upper barrel. The push member 72, the lever 75, and the dial 78 correspond to the pressurization member 62 of the left barrel 12. When the dial 78 is operated, the link member 65 operates in response to engagement between the engagement portion 68*a* and the engagement counterpart portion 65*a*. The pressurization projection 62*a* is pushed by the push member 72 and protrudes into the cartridge portion 14, or the protruding amount changes (FIG. 15B). The change of the protruding amount corresponds to the range of the sight adjustment amount, and the adjustment amount is indicated by the mark 78*a* (FIG. 15A).

Figure 16A:
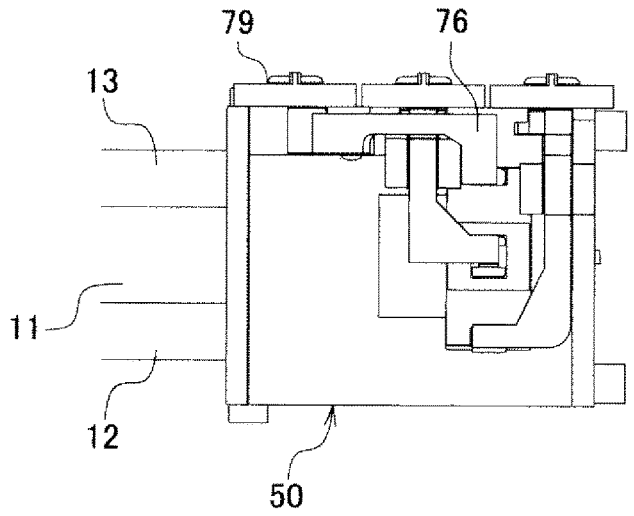
FIG. 16A is a top view.
Figure 16B:
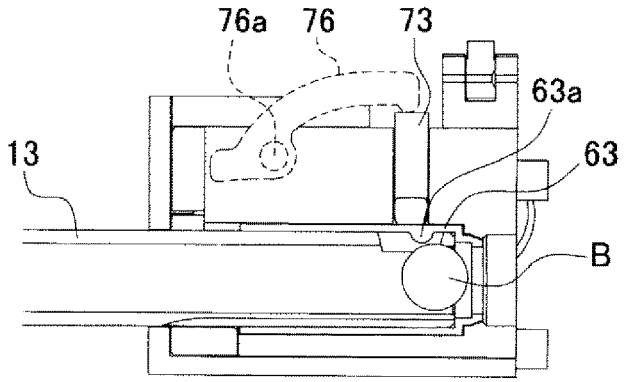
FIG. 16B is a longitudinal sectional view taken along the central line.
Figure 16C:
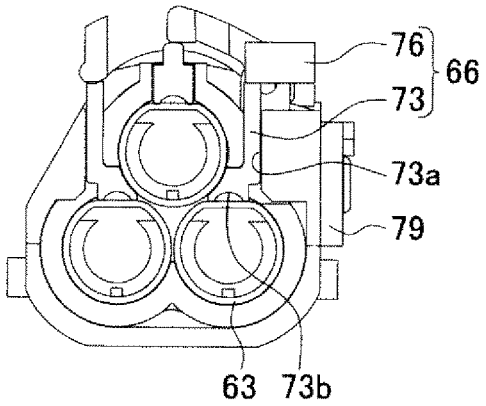
FIG. 16C is a cross-sectional view.
Figure 17A:
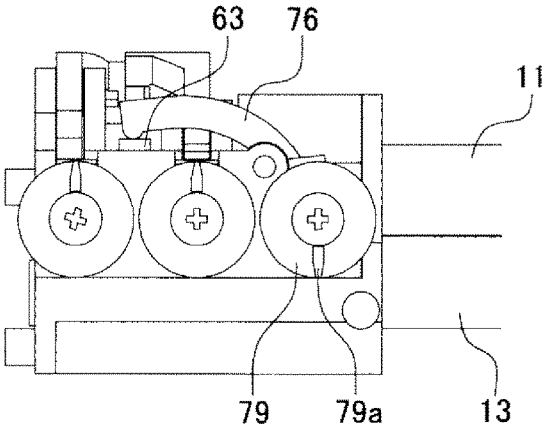
FIG. 17A is a right-side view.
Figure 17B:
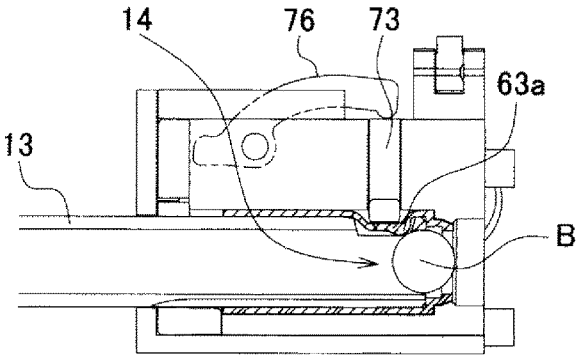
FIG. 17B is a longitudinal sectional view taken along the central line.
Figure 17C:
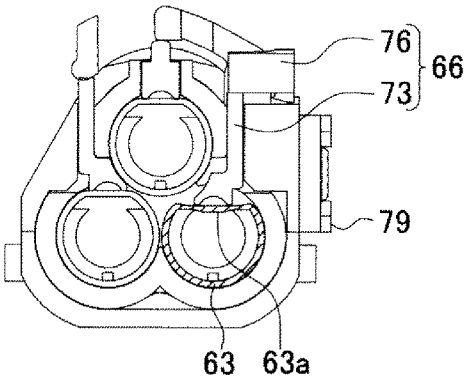
FIG. 17C is a cross-sectional view.

Similarly, FIG. 16 illustrates a configuration relating to the sight adjustment in the right barrel 13, that is, a state before an adjustment operation is performed, similar to the upper barrel. The push member 73, the lever 76, and the dial 73 correspond to the pressurization member 63 of the right barrel 13. When the dial 79 is operated, the link member 66 operates in response to engagement between the engagement portion 69*a* and the engagement counterpart portion 66*a*. The pressurization projection 63*a* is pushed by the push member 73 and protrudes into the cartridge portion 14, or the protruding amount changes (FIG. 17B). The change of the protruding amount corresponds to the range of the sight adjustment amount, and the adjustment amount is indicated by the mark 79*a* (FIG. 17A).

In the electric gun G which is at simulation gun in which the sight adjustment device of the present invention is applied, when a trigger 17 is pulled, the switch 18 is turned on, and a drive circuit is closed due to the turning-on operation. Then, the electric mechanism 40 is actuated, and the pistons 31, 32, 33 start to retract. Subsequently, the latch member 49 and the engagement counterpart portion 49*a* engage with each other, and are disengaged from each other by the disengagement portion 49*b*. Then, a next bullet is loaded while the nozzle base 29 retracts and advances. When the pistons 31, 32, 33 reach the vicinity of a retraction limit, the sector gear 41 of the electric mechanism 40 rotates from the toothed portion 41*a* to the non-toothed portion 41*b* and is unmeshed from the rack 36. As a result, pressure accumulated in the elastic member 42 is released, and the pistons 31, 32, 33 instantaneously move to an advancing limit. Then, air inside the cylinder is compressed and is blasted as compressed air from the blast nozzle 24. Consequently, one shot each from three barrels 11, 12, 13, that is, three bullets B in total are shot.

The invention claimed is:

1. A sight adjustment device, which adjusts a shooting course of a bullet loaded in a cartridge portion of each of a plurality of barrels of a simulation gun, and the sight adjustment device comprising:

an operation unit, a link member and a plurality of pressurization members;

wherein the operation unit is provided on a main body of the gun and the operation unit adjusts a backspin amount for the bullet, wherein one end portion of the link member is disposed on the operation unit, the other end portion of the link member is disposed on at least one of the plurality of pressurization members, and the link member transmits the backspin amount to the plurality of pressurization members, and wherein each of the plurality of pressurization members is provided in each of cartridge portions of the plurality of barrels and adds pressure corresponding to the backspin amount to the bullet in each of cartridge portions of the plurality of barrels, thereby applying a rotational motion to the bullet at the time of shooting.

2. The sight adjustment device according to claim 1, wherein the operation unit has an engagement portion and an engagement counterpart portion, the engagement portion is configured as a multi-spiral portion in a rotary operation piece, the engagement counterpart portion is provided on an end portion of the link member and able to engage with the engagement portion.

3. The sight adjustment device according to claim 1, wherein each of the plurality of pressurization members is provided in upper portion of each of cartridge portions of the plurality of barrels and has a pressurization projection that comes into contact with an upper portion of the bullet in the cartridge portion, and wherein the pressurization member adds downward pressure corresponding to the backspin amount to the bullet in each of cartridge portions of the plurality of barrels, thereby applying an upward rotational motion to the bullet at the time of shooting.

4. The sight adjustment device according to claim 1, wherein the sight adjustment device has a plurality of the operation units and a plurality of the link members, wherein each of the plurality of the operation units independently adjusts the backspin amount for the bullet, wherein each of the link members independently transmits the backspin amount at the operation unit to one of the plurality of pressurization members, and wherein each of the plurality of pressurization members adds pressure corresponding to the independently operated backspin amount to the bullet in each of cartridge portions of the plurality of barrels, thereby applying a rotational motion to the bullet at the time of shooting.

5. The sight adjustment device according to claim 1, wherein the link member has a lever and a push member, wherein the lever is pivotally supported between the one end portions and the other end portions, and one end portion of the lever communicates with the operation unit, wherein the push member is movable in a vertical direction and a lower end portion of the push member comes into contact with one of the plurality of pressurization members, and wherein the other end portion of the lever and a lower end portion of the push member come into contact with each other.

* * * * *